US011047074B2

(12) United States Patent
Rouby et al.

(10) Patent No.: US 11,047,074 B2
(45) Date of Patent: Jun. 29, 2021

(54) WEAVING MACHINE AND CORRESPONDING WEAVING METHOD

(71) Applicant: COMPAGNIE GENERALE DES ETABLISSEMENTS MICHELIN, Clermont-Ferrand (FR)

(72) Inventors: Mickael Rouby, Clermont-Ferrand (FR); Christophe Bessac, Clermont-Ferrand (FR); Alexis Dechelle, Clermont-Ferrand (FR); Guy Chevrel, Clermont-Ferrand (FR)

(73) Assignee: COMPAGNIE GENERALE DES ETABLISSEMENTS MICHELIN, Clermont-Ferrand (FR)

( * ) Notice: Subject to any disclaimer, the term of this patent is extended or adjusted under 35 U.S.C. 154(b) by 139 days.

(21) Appl. No.: 16/471,660

(22) PCT Filed: Dec. 19, 2017

(86) PCT No.: PCT/EP2017/083456
§ 371 (c)(1),
(2) Date: Jun. 20, 2019

(87) PCT Pub. No.: WO2018/114895
PCT Pub. Date: Jun. 28, 2018

(65) Prior Publication Data

US 2019/0382929 A1 Dec. 19, 2019

(30) Foreign Application Priority Data

Dec. 20, 2016 (FR) ..... 1662897

(51) Int. Cl.
*D03D 41/00* (2006.01)
*D03D 49/46* (2006.01)
(Continued)

(52) U.S. Cl.
CPC ..... *D03D 41/00* (2013.01); *D03D 13/002* (2013.01); *D03D 49/46* (2013.01); *D03J 5/02* (2013.01)

(58) Field of Classification Search
CPC ..... D03D 41/00; D03D 13/002; D03D 49/46; D03D 49/68; D03J 5/02
See application file for complete search history.

(56) References Cited

U.S. PATENT DOCUMENTS 1,280,461 A * 10/1918 Heilig ..... D03D 13/002 139/11
3,732,896 A * 5/1973 Jekl ..... D03D 47/261 139/436
(Continued)

FOREIGN PATENT DOCUMENTS

DE 370 135 C 2/1923
DE 10 2013 208449 A1 11/2014
EP 1 950 033 A1 7/2008

OTHER PUBLICATIONS

International Search Report dated Apr. 6, 2018, in corresponding PCT/EP2017/083456 (6 pages).

*Primary Examiner* — Robert H Muromoto, Jr.
(74) *Attorney, Agent, or Firm* — Venable LLP

(57) ABSTRACT

ABSTRACT
This weaving machine (2) includes a structure (4) able to support a plurality of warp threads (16) extending in a first direction, a heddles mechanism (18) capable of selectively moving at least some of the plurality of warp threads (16) to form first and second sheets (28, 30) of warp threads, and at least one weft-thread feed spool (38). The weaving machine (2) also includes at least one support shuttle (44) for the feed spool and an actuating device (32) able to control a movement of the shuttle (44) between the first and second sheets (28, 30) of warp threads in at least one second direction
(Continued)

transverse to the first direction, in both senses relative to the second direction, to continuously lay the weft thread (43) coming from the feed spool (38) between the sheets (28, 30) and in the second direction.

12 Claims, 6 Drawing Sheets

(51) Int. Cl.
*D03D 13/00* (2006.01)
*D03J 5/02* (2006.01)

(56) References Cited

U.S. PATENT DOCUMENTS

| | | | | | |
|---|---|---|---|---|---|
| 3,968,817 | A * | 7/1976 | Bezstarosti | D03D 47/265 | 139/436 |
| 4,410,017 | A * | 10/1983 | Linka | D03D 47/261 | 139/436 |
| 8,361,911 | B2 * | 1/2013 | Legrand | D03D 25/005 | 442/205 |
| 8,561,649 | B1 * | 10/2013 | Legrand | D03D 25/005 | 139/11 |
| 10,786,053 | B2 * | 9/2020 | Siahaan | D03D 41/00 | |
| 2008/0196940 | A1 * | 8/2008 | Stobbe | H01Q 1/273 | 174/70 R |
| 2010/0269948 | A1 * | 10/2010 | Legrand | D03D 25/005 | 139/384 R |
| 2013/0263966 | A1 * | 10/2013 | Legrand | D03D 41/00 | 139/11 |
| 2016/0083876 | A1 * | 3/2016 | Thiel | D03D 13/002 | 139/419 |
| 2016/0309857 | A1 * | 10/2016 | Siahaan | D03D 3/005 | |
| 2018/0303596 | A1 * | 10/2018 | Du | A61F 2/07 | |

* cited by examiner

WEAVING MACHINE AND CORRESPONDING WEAVING METHOD

BACKGROUND

The invention relates to the field of weaving, and more specifically to the field of weaving machines and industrial weaving methods for manufacturing fabrics, notably composite fabrics designed for use as strengthening elements for tyres.

Industrial weaving machines are known for manufacturing fabrics for multiple applications, such as making textile products.

Conventionally, a weaving machine has a structure bearing a plurality of warp threads extending in a first direction. A heddle mechanism selectively moves at least some of the plurality of warp threads to form first and second sheets of warp threads.

An industrial weaving machine also has a weft-thread feed spool mounted on the structure and means for laying this thread, for example a needle. The needle catches an end of the weft thread from the spool such as to move this weft thread between the first and second sheets of warp threads in a second direction perpendicular or oblique to the first direction. The needle releases the end of the weft thread once said thread has passed the plurality of warp threads. The weft thread is then cut at a portion located at the end opposite the end that has just been released. The needle is returned to the starting position thereof, the warp threads are moved selectively to form sheets according to a different arrangement, then the actions described above are repeated to lay in new portion of weft thread between the sheets.

Such industrial weaving machines enable production of fabrics at a high rate while enabling a satisfactory laying quality of the weft thread.

However, a drawback of industrial weaving machines is that the diversity of fabrics produced using such machines is limited. Notably, a conventional industrial weaving machine of the type described above only enables production of fabrics with a discontinuous weft thread.

In consideration of the foregoing, the invention is intended to propose an industrial weaving machine and an industrial weaving method that overcomes the aforementioned drawbacks.

More specifically, the invention is intended to provide an industrial weaving machine and an industrial weaving method that is able to produce a significant range of fabrics at a fast rate, in particular continuous weft thread fabrics, without complicating the design of the weaving machine or complicating the work of the operator.

SUMMARY

For this purpose, a weaving machine is proposed, comprising a structure able to support a plurality of warp threads extending in a first direction, a heddle mechanism capable of selectively moving at least some of the plurality of warp threads to form first and second sheets of warp threads, at least one weft-thread feed spool, and at least one support shuttle for said feed spool.

According to a general feature, this weaving machine also includes an actuating device able to control a movement of said shuttle between the first and second sheets of warp threads in at least one second direction transverse to the first direction, and in both senses relative to said second direction, to continuously lay the weft thread coming from the feed spool between said sheets and in said second direction.

Such a weaving machine helps to improve the diversity of fabrics that can be produced, in particular continuous weft thread fabrics, at a fast production rate, while maintaining a simple design of the weaving machine and without complicating the work of the operator. 'Second direction transverse to the first direction' means that the second direction is secant to the first direction, i.e. not parallel to the first direction. Unlike a discontinuous weft-thread fabric, a continuous weft-thread fabric is a fabric in which the weft thread makes several passes between the plurality of warp threads, said weft thread being a single continuous portion, i.e. unbroken.

According to one embodiment, the weaving machine has means for adjusting a weaving angle corresponding to the angle formed between the second direction and the first direction.

The weaving machine according to this embodiment also makes it possible to vary the weaving angle, the angle formed between the direction of the weft thread and the direction of the warp threads, such as to further increase the diversity of fabrics that can be obtained.

Advantageously, said adjustment means are designed to enable a variation in the weaving angle between 40° and 90°.

According to one embodiment, the adjustment means include a mechanical pivot link designed to enable the actuating device to pivot about a direction perpendicular to the direction of the movement of the shuttle.

Advantageously, the adjustment means include a sliding mechanical link designed to enable the translational movement of a stop element for stopping the movement of the shuttle.

Preferably, the actuating device includes a rack actuator and means for hitching a movable element of the rack actuator to said shuttle.

The use of a rack actuator coupled to hitching means makes it possible to simply and reliably move the shuttle between the sheets of weft threads. Furthermore, the rack guides the movement of the shuttle, which makes the weaving machine particularly suited to large diameter weft threads (in the range 0.5 mm to 1.4 mm), such as those typically used in tyre strengthening fabric.

According to one embodiment, the hitching means include a first ferromagnetic element designed to cooperate with a second ferromagnetic element mounted on said shuttle, at least one of the first and second ferromagnetic elements being an electromagnet or a permanent magnet.

Throughout the present application, the term 'ferromagnetic' is used according to the normal sense, i.e. a ferromagnetic material is a material that can be magnetized under the effect of an external magnetic field.

The use of hitching means including ferromagnetic elements helps to keep the design of the weaving machine simple, without complicating the work of the operator and maintaining a satisfactory level of reliability when using the machine.

According to one embodiment, the structure has a device for disconnecting said shuttle from the actuating device, said disconnection device having an electromagnet or a permanent magnet.

The use of such a disconnection device notably including an electromagnet and/or a permanent magnet, like the hitching means including ferromagnetic elements, makes it possible to optimize the compromise between simplicity of design, complexity of the work of the operator and usage reliability of the machine.

In an advantageous embodiment, the hitching means and the disconnection device together have three permanent magnets and one electromagnet. This simplifies the design of the machine.

According to one embodiment, the machine also has a slatted beater, said beater being removable.

Slatted beaters are particularly suitable for weaving machines used to manufacture composite fabrics intended for use in tyres, in consideration of the stiffness of the materials used to form the warp threads and/or the weft threads, and the resulting friction. Furthermore, the use of removable beaters enables the use of beaters that are particularly suited to a particular type of fabric to be obtained using the weaving machine, such as a fabric having a specific weaving angle, for example.

Advantageously, the structure has at least one clamp positioned on one side of the plurality of warp threads in line with the second direction, said at least one clamp being designed to capture a weft thread when said weft thread is laid between the warp threads.

Preferably, the spool has means for orienting the output direction of the weft thread from the spool.

According to another aspect, a weaving method is proposed that uses a weaving machine including a plurality of warp threads extending in a first direction, in which at least some of the plurality of warp threads are moved selectively to form first and second sheets of warp threads, then an actuating device is controlled to move at least one support shuttle for at least one feed spool for weft thread between the first and second sheets of warp threads in at least one second direction transverse to the first direction, and in both senses relative to said second direction, to continuously lay the weft thread coming from the feed spool between said sheets and in said second direction.

In an advantageous embodiment, the following steps are implemented:

- hitching means of a movable element of the actuating device are actuated to rigidly connect said shuttle and said movable element together,
- said movable element is commanded to move between the first and second sheets of warp threads in said second direction and in a first sense,
- a device for disconnecting said shuttle from the actuating device is activated,
- said movable element is commanded to move between the first and second sheets of warp threads in said second direction and in a second sense opposite the first sense,
- at least some of the plurality of warp threads are moved selectively to change the position of the first and second sheets of warp threads,
- said movable element is commanded to move between the first and second sheets of warp threads in said second direction and in the first sense,
- the disconnection device is deactivated, and
- said movable element is commanded to move between the first and second sheets of warp threads in said second direction and in the second sense.

Preferably, the warp thread is made of metal and/or the weft thread is made of a textile material. The metal warp thread is advantageously made of steel.

According to another aspect, a fabric obtained using a method such as the one described above is proposed.

According to yet another aspect, a tyre is proposed that has a crown comprising a belt reinforcement and a sculpted tread extended by two flanks, in which at least one tyre zone is reinforced by a fabric obtained using the method.

BRIEF DESCRIPTION OF THE FIGURES

Other objectives, features and advantages of the invention are set out in the description below, given purely by way of non-limiting example and with reference to the attached drawings, in which.

DETAILED DESCRIPTION

Figure 1:
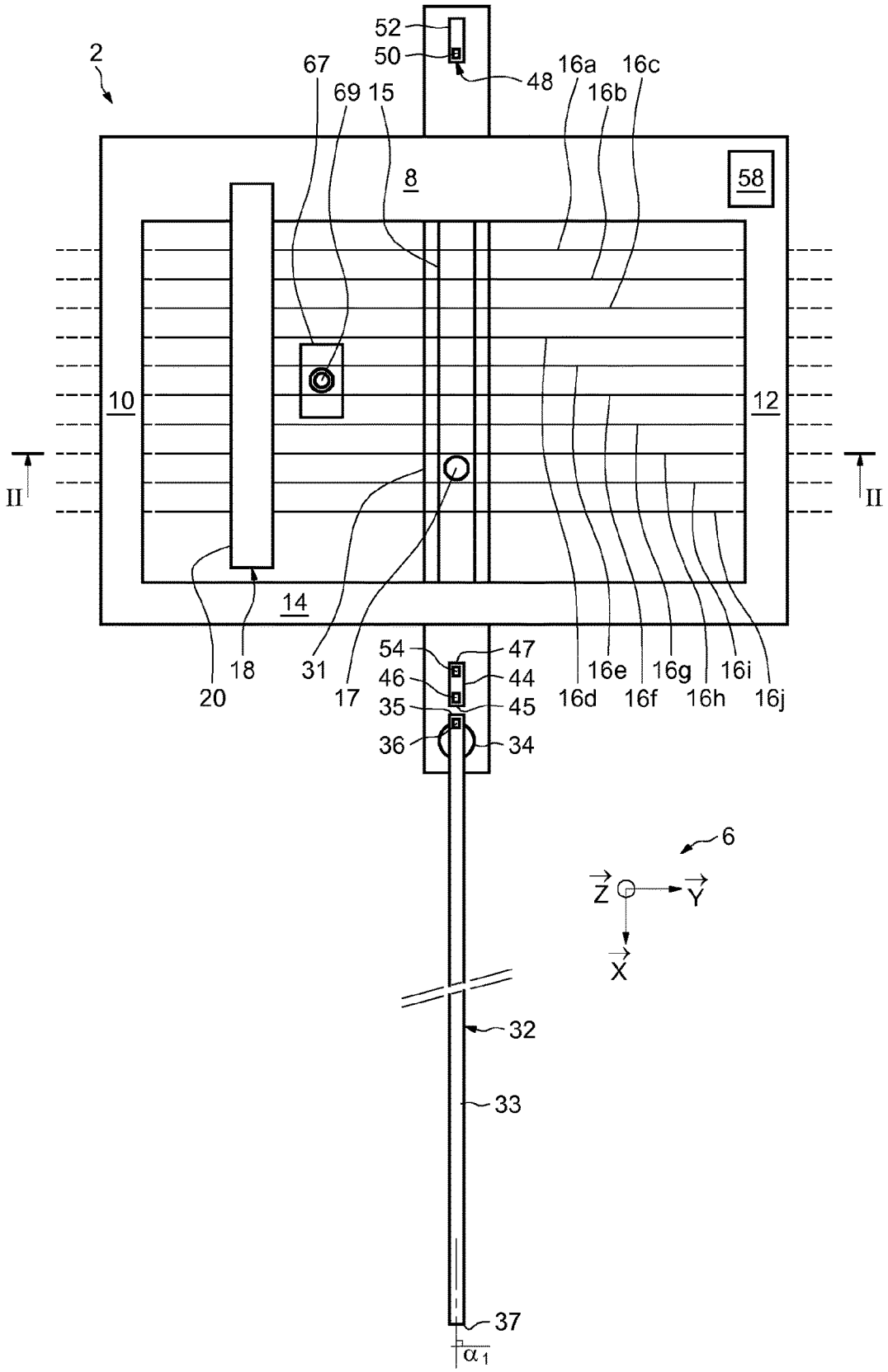
FIG. 1 is a schematic top view of a weaving machine according to an example embodiment of the invention.
Figure 2:
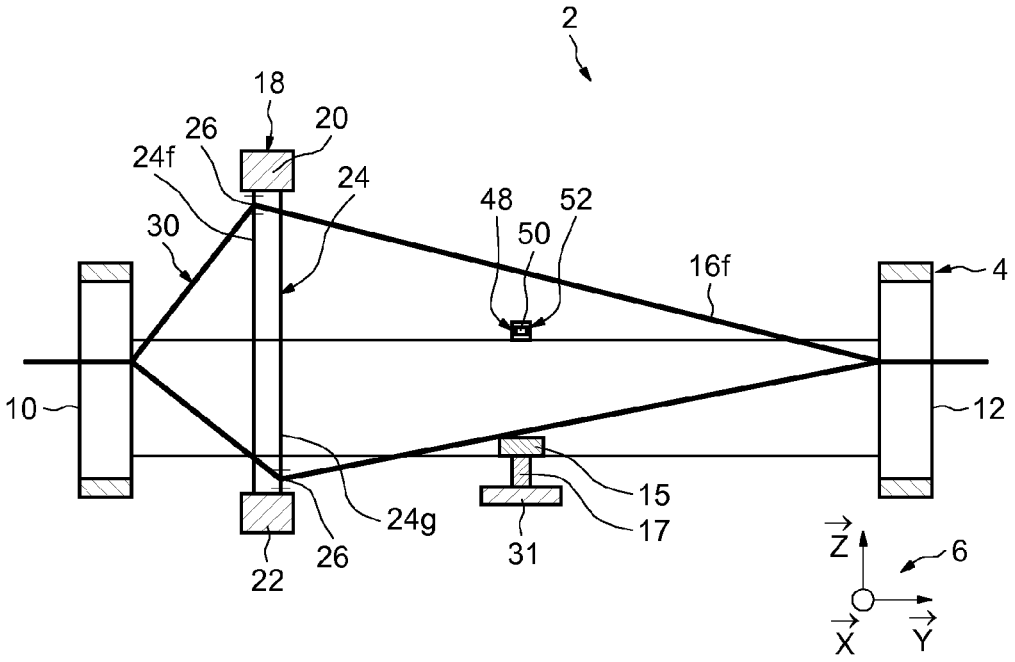
FIG. 2 is a cross-section view along the line II-II in FIG. 1.
Figure 3:
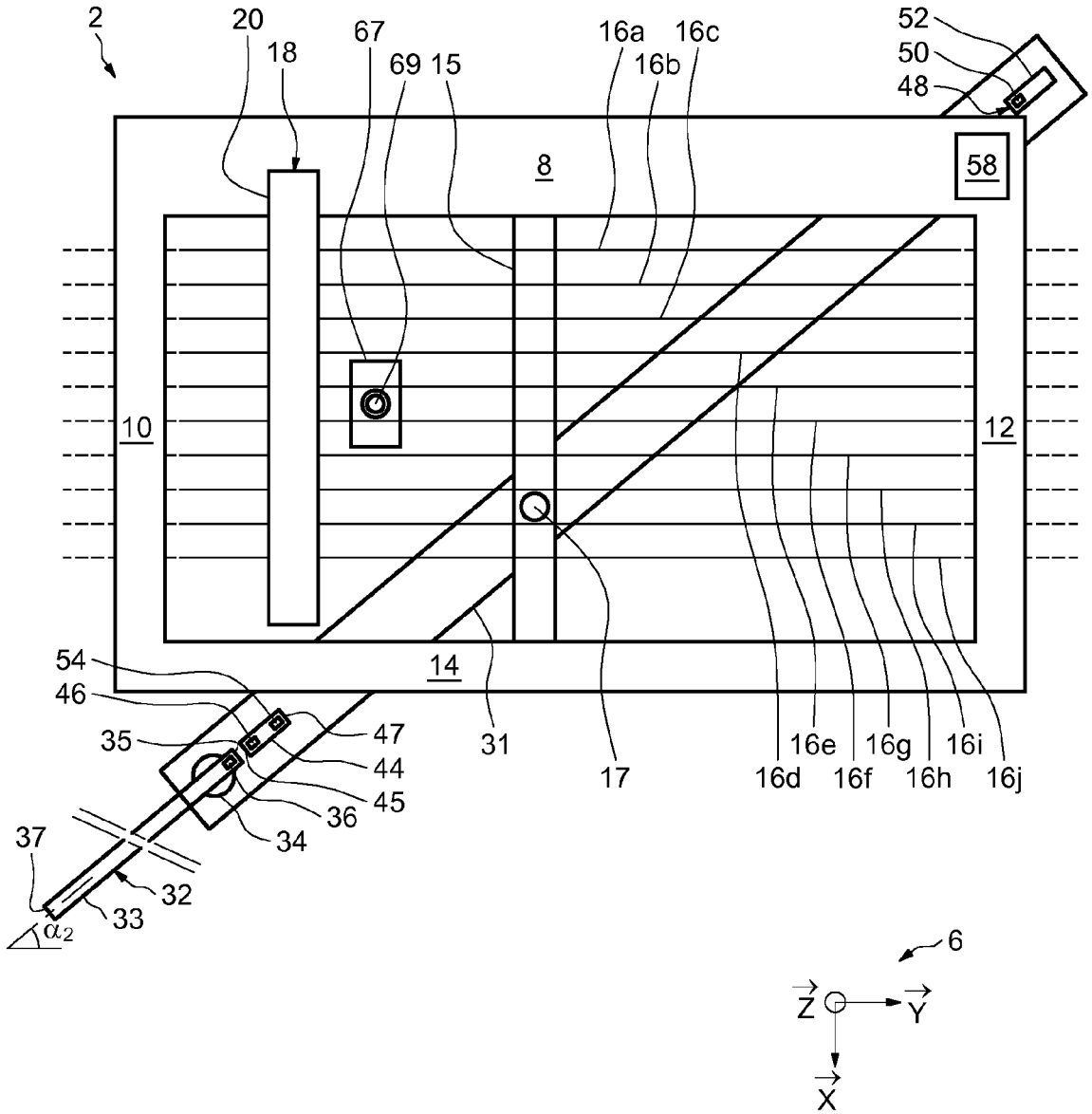
FIG. 3 is a top view of the weaving machine in FIGS. 1 and 2 according to a different weaving arrangement.

FIGS. 1 to 3 show a weaving machine 2 according to an example embodiment of the invention. The weaving machine 2 is used to produce fabrics, notably composite fabrics, and more specifically fabrics intended to reinforce tyres. More specifically, the fabrics produced are intended to be enveloped in a rubber mixture by calendering such as to form calendered products. The machine 2 is shown in FIGS. 1 and 2 according to a first operating arrangement and in FIG. 3 according to a second operating arrangement. The machine 2 has a structure 4 forming the frame thereof.

For the sake of clarity and comprehension, an orthonormal vector base 6 relating to the structure 4 is provided. The base 6 comprises a vector $\vec{x}$, a vector $\vec{y}$ and a vector $\vec{z}$. As shown in the figures, the vector $\vec{x}$ is oriented parallel to a transverse direction of the structure 4, the vector $\vec{y}$ being parallel to a longitudinal direction of the structure 4. The weaving machine 2 is designed to be installed such that the vector $\vec{z}$ relating to the structure 4 is vertical and oriented upwards. In other words, the vector $\vec{z}$ is parallel to a vertical direction defined in relation to the structure 4. In these conditions, the plane formed by the vectors $\vec{x}$ and $\vec{y}$ is horizontal.

In the present application, the expressions 'downwards', 'upwards', 'lower' and 'upper' shall be understood with reference to the base 6 with the weaving machine 2 installed normally, i.e. assuming that the vector $\vec{z}$ is oriented vertically upwards. Equally, the terms 'left' and 'right' shall be understood relatively in relation to the vector $\vec{x}$, the left-hand side being the starting point of the vector $\vec{x}$ and the right-hand side being the end point of the vector $\vec{x}$.

The structure 4 has an oblong-shaped main body 8 oriented in the direction of the vector $\vec{y}$. The body 8 is extended by a first cross arm 10 and a second cross arm 12. The cross arms 10 and 12 extend from the two respective ends of the body 8 in the direction and sense of the vector $\vec{x}$. Each of the arms 10, 12 is oblong shaped and is oriented parallel to the direction of the vector $\vec{x}$. The arms 10 and 12 are of the same length. The structure 4 also has a longitudinal arm 14. The arm 14 is connected on one side to the end of the arm 10 opposite the connection end to the body 8 and on the other side to the end of the arm 12 opposite the connection end to the body 8. The arms 14 extend between these ends in the direction of the vector $\vec{y}$.

As shown in FIGS. 1 to 3, the structure 4 also has a cross beam 15 linking the main body 8 to the longitudinal arm 14. More specifically, the beam 15 extends in the direction of the vector $\vec{x}$ from a lower portion (not referenced) of the body 8 to a lower portion (not referenced) of the arm 14. The beam 15 also has a shaft 17 extending in the direction of the vector $\vec{z}$. In the example shown, the shaft 17 is positioned on the beam 14 at a distance from the body 8 of between one half and three quarters of the length of the beam 14. However, it is understood that the shaft 17 can be placed at a different position on the beam 15 or on the body 8 or on the arm 14 without thereby moving outside the scope of the invention.

The structure 4 carries a plurality of warp threads indicated as a whole using reference sign 16. In the example shown, ten warp threads 16*a*, 16*b*, 16*c*, 16*d*, 16*e*, 16*f*, 16*g*, 16*h*, 16*i* and 16*j* are arranged in succession and in this order in the direction and the sense of the vector $\vec{x}$. Naturally, the number of threads shown here is in no way limiting.

With the help of the structure 4, and more specifically the arms 10 and 12, the warp threads 16 extend in the longitudinal direction of the structure 4 parallel to the vector $\vec{y}$. For example, the arm 10 can have a perforated plate (not shown), the warp threads 16 passing respectively through the perforations in the perforated plate held by the arm 10. On the other side, the arm 12 can have two rollers (not shown) between which the fabric made is passed. Alternatively, a single roller about which the fabric made is wound can be provided. Thus, the arms 10 and 12 hold the portion of the warp threads 16 facing the arms 10 and 12 in the direction of the vectors $\vec{x}$ and $\vec{z}$.

The weaving machine 2 can also have a feed mechanism (not shown) for the fabric and therefore the warp threads 16. In a known manner, such a mechanism can include an electric motor (not shown) driving a roller causing the simultaneous movement of the fabric and therefore the warp threads 16 in the direction of the vector $\vec{y}$.

The structure 4 is also provided with a heddle mechanism 18 including an upper cross arm 20 and a lower cross arm 22 that face one another vertically. The arm 20 has a vertical portion (not referenced) extending from the upper surface of the body 8 in the direction and in the sense of the vector $\vec{z}$. The arm 22 has a vertical portion (not referenced) extending from a lower surface of the body 8 in the direction of the vector $\vec{z}$ and in the sense opposite the vector $\vec{z}$. Each arm 20, 22 has a horizontal portion (not referenced) extending respectively from the upper or lower end of the vertical portion of said arm 20, 22 in the direction and in the sense of the vector $\vec{x}$.

Figure 4:
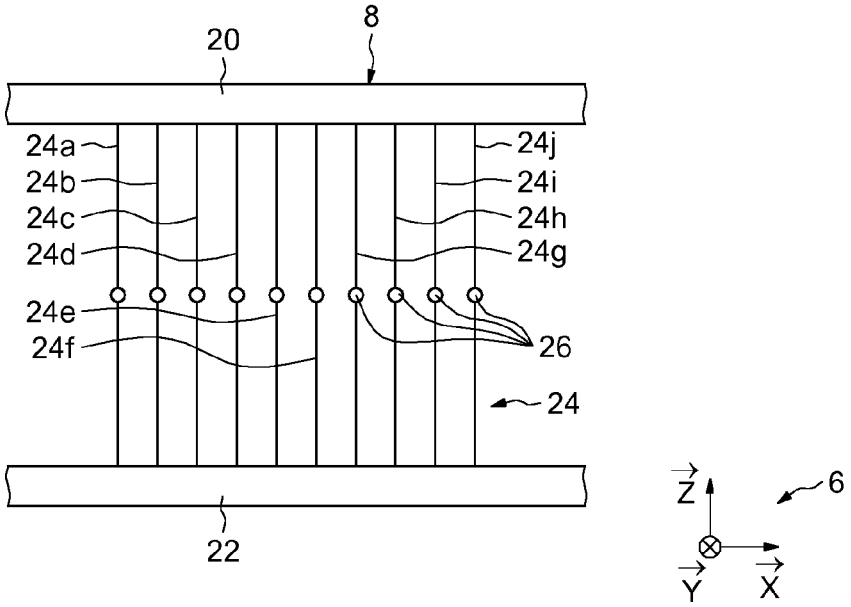
FIG. 4 is a schematic representation of the operating principle of a heddle mechanism of the weaving machine in FIGS. 1 to 3.

The operating principle of the heddle mechanism 18 is shown schematically in FIG. 4. The heddle mechanism 18 also has a plurality of heddles indicated as a whole using reference sign 24. In this case, the mechanism 18 has ten heddles 24*a*, 24*b*, 24*d*, 24*e*, 24*f*, 24*g*, 24*h*, 24*i* and 24*j*. The heddles 24 are oriented in the direction of the vector $\vec{z}$, the mechanism 18 having means (not shown) designed to selectively move each heddle 24*a* to 24*j* in translation in relation to the structure 4 in the direction of the vector $\vec{z}$. Furthermore, each heddle 24*a* to 24*j* is located in the planed formed by each warp thread 16*a* to 16*j*, respectively, and by the vector $\vec{z}$. Each heddle 24*a* to 24*j* has a thread or a metal bar extending on either side of an eyelet 26 through which the related warp thread 16*a* to 16*j* is passed.

The heddle mechanism 18 can be used to selectively move at least some of the warp threads 16 such as to form several sheets of warp threads. More specifically, in the example embodiment shown, the mechanism 18 is designed to selectively move half of the heddles upwards and the other half of the heddles downwards. The heddle mechanism 18 thus divides the heddles 24 into two groups of heddles, a first group comprising the heddles 24*b*, 24*d*, 24*f*, 24*h* and 24*j* and a second group comprising the heddles 24*a*, 24*c*, 24*e*, 24*g* and 24*i*. The mechanism 18 thus forms two sheets, one lower and the other upper. The sheets correspond respectively to the threads associated with the first group and to the threads associated with the second group, the mechanism 18 then periodically alternating the position of the two sheets.

Again with reference to FIG. 2, the mechanism 18 has caused the first group of heddles 24 to move in the sense opposite the vector $\vec{z}$ and the mechanism 18 has caused the second group of heddles 24 to move in the sense of the vector $\vec{z}$. As a result, half of the warp threads 16, and more specifically the warp threads 16*a*, 16*c*, 16*e*, 16*g* and 16*i*, are selectively shifted downwards in relation to the structure 4 and form a first lower sheet 28. Equally, the other half of the warp threads 16, i.e. the warp threads 16*b*, 16*d*, 16*f*, 16*h* and 16*i*, are shifted upwards in relation to the structure 4 to form a second upper sheet 30.

With reference to FIGS. 1 to 3, the machine 2 has a moveable oblong section 31. The section 31 is mounted rotatably about the shaft 17. This means that the section 31 pivots about the direction of the vector $\vec{z}$ in relation to the beam 15 and the structure 4. The longitudinal direction of the section 31 forms an angle $\alpha$ with the direction of the vector $\vec{y}$. As explained below, the angle $\alpha$ is the weaving angle used by the machine 2.

More specifically, the angle $\alpha$ can vary between a first extreme value $\alpha_1$ and a second extreme value $\alpha_2$. In the example shown, the angle $\alpha_1$ is substantially equal to 90°, the angle $\alpha_2$ being substantially equal to 40°. FIGS. 1 and 3 respectively show the section 31 pivoted according to two different operating arrangements of the machine 2, the arrangement in FIG. 1 corresponding to an angle $\alpha_1$, and the arrangement in FIG. 2 corresponding to an angle $\alpha_2$.

In the example shown, the shaft 17 has an electric motor (not shown) for driving the section 31 in rotation about the direction of the vector $\vec{z}$. Other means may nonetheless be used to cause this rotation without thereby moving outside the scope of the invention. For example, in a variant, the rotation of the section 31 about the direction of the vector $\vec{z}$ in relation to the structure 4 is caused manually by the operator.

Again with reference to FIG. 1, the machine 2 also has an actuating device 32 mounted on the arm 14. As explained below, the actuating device 32 is provided to cause the movement of a weft-thread spool in order to carry out the weaving. To do so, the actuating device 32 notably has a rod 33, the longitudinal direction of which coincides with the weaving direction used by the machine 2. The rod 33 is mounted on the section 31 such that the longitudinal direction thereof substantially coincides with the longitudinal direction of the section 31. Consequently, the angle formed between the longitudinal direction of the rod 33 and the direction of the vector 9 is equal to the angle $\alpha$. More specifically, the rod 33 is mounted on a pin 34 extending from one end of the section 31 in the direction and the sense of the vector Y. In the example shown, the pin 34 extends from the end of the section 31 adjacent to the arm 14, although the pin may also extend from the other end of the section 31 without thereby moving outside the scope of the invention. The rod 33 has two ends 35 and 37 that are opposite one another.

The actuating device 32 has a rack actuator (not shown) that is intended to cause the rod 33 to move in translation in relation to the pin 34. For this purpose, the rack actuator can include an electric motor for driving a pinion gear cooperating with a rack. For example, the electric motor has a casing rigidly connected to the movable portion of the pin 34, the pinion gear meshing with a rack that is part of the rod 33 and that extends in the longitudinal direction of said rod 33. The rack advantageously extends over the entire length of the rod 33 between the ends 35 and 37. Consequently, the rod 33 can move between a first end position in which the end 35 is close to the pin 34, as shown in FIGS. 1 and 3, and a second end position (not shown) in which the end 37 is close to the pin 34.

Thus, the pivoting section 31 and the rack actuator (not shown) can be used to move the rod 33 in rotation about the direction of the vector $\vec{z}$ and in translation in the longitudinal direction of the rod 33, in relation to the structure 4.

The actuating device 32 also has hitching means. The hitching means are intended to enable the rod 33 to be rigidly connected to a support shuttle for the weft-thread feed spool. For this purpose, the end 35 of the rod 33 has a permanent magnet 36. As explained below, the permanent magnet 36 is designed to cooperate with a corresponding permanent magnet on the shuttle.

With reference to FIGS. 1 and 3, the machine 2 also includes a support 67. The support 67 is deliberately not shown in FIG. 2 to enhance the clarity of the drawing. The support 67 has a substantially parallelepiped shape and includes an attachment screw 69. The support 67 is mechanically connected to the structure 4 using a sliding mechanical link in relation to the direction of the vector 9. As explained below with reference to FIGS. 6 and 7, the screw 69 is provided to attach a beater.

Figure 5:
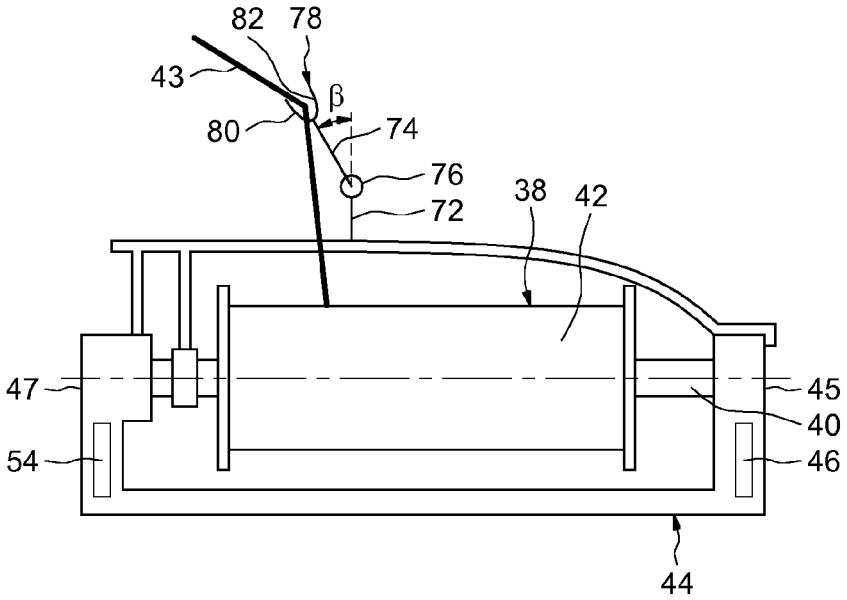
FIG. 5 is a front view of a spool and of a support shuttle for the weaving machine in FIGS. 1 to 3, FIGS. 6 and 7 are top views of two slatted beaters of the weaving machine in FIGS. 1 to 3.

With reference to FIG. 5, the machine 2 has a spool 38 including a shaft 40 and a cylindrical magazine 42. A weft thread 43 is wound about the cylindrical wall of said magazine 42. The shaft 40 is mechanically and removably connected to a support shuttle 44 of the spool 38. More specifically, the spool 38 is able to pivot about its shaft 40 in relation to the shuttle 44.

The shuttle 44 is oblong shaped, and the longitudinal direction of the shuttle 44 coincides substantially with the direction of the shaft 40. The shuttle 44 has two ends 45 and 47.

With reference to FIGS. 1, 3 and 5, the shuttle 44 has a permanent magnet 46 arranged on the end 45 thereof. The magnet 46 is polarized such as to be attracted by the magnet 36. More specifically, the magnets 36 and 46 are designed to impart a magnetic attraction force $\varepsilon_{36\text{-}46}$ enabling the shuttle 44 supporting the spool 38 to remain attached to the shaft 33. In other words, in the absence of other forces, the shuttle 44 supporting the spool 38 forms an assembly rigidly connected to the end 35.

In this case, the magnets 36 and 46 are dimensioned such that the force $\varepsilon_{36\text{-}46}$ satisfies the following inequation:

$$\varepsilon_{36\text{-}46} \geq m \cdot (g + a_{max}),$$

in which:

m is the mass of the shuttle 44 supporting the spool 38 loaded with weft thread 43, g is the acceleration of gravity, and $a_{max}$ is the maximum acceleration undergone by the rod 33 during movement thereof in relation to the structure 4.

The machine 2 also has a disconnection device 48 that is used to exert an additional force on the shuttle 44 such as to break the rigid assembly formed by the rod 33 on one hand and by the shuttle 44 and the spool 38 on the other hand.

With reference to FIGS. 1 and 3, the disconnection device 48 has an electromagnet 50 mounted on a support 52. The support 52 is mounted on the section 31 as a longitudinal extension of the rod 33 and at an end of the section 31 opposite the end on which the pin 34 is located. As shown in FIGS. 1, 3 and 4, the disconnection device 48 has a permanent magnet 54 built into the second end 47 of the shuttle 44. The magnet 54 is polarized such that, when the electromagnet 50 is powered with electrical energy, the magnet 54 and the electromagnet 50 exert an electromagnetic attraction force $\varepsilon_{50\text{-}54}$ sufficient to overcome the magnetic attraction force $\varepsilon_{36\text{-}46}$.

In this case, the electromagnet 50 and the permanent magnet 54 are dimensioned such that the force ε50-54 is strictly greater than the force ε36-46, and preferably equal to or greater than the force ε36-46 multiplied by a factor of at least 1.5.

As explained below, the actuating device 32 moves the spool 38 in translation in the longitudinal direction of the rod 33 such as to arrange the weft thread 43 in that same longitudinal direction of the rod 33. Consequently, the laying direction of the weft thread 43 coincides with the longitudinal direction of the rod 33 and the weaving angle, which is the angle formed between the direction of the weft thread 43 laid and the direction of the warp threads 16, is the angle $\alpha$.

With reference to FIGS. 1 and 3, the machine 2 also has a control device 58 including hardware and software means for controlling the different actuators of the machine 2. More specifically and in the example shown, the control device controls:

the means designed to selectively move the heddles 24, the electric motor for driving the section 31 in rotation, the electric motor of the rack actuator, and the electromagnet 50.

When the section 31 is rotated by the electric drive motor, the control device 58 can also have an input interface for a weaving angle $\alpha_{consigne}$. As a function of the angle $\alpha_{consigne}$, the device is 58 controls the rotation of the pin 34 such that the angle $\alpha$ is equal to the angle $\alpha_{consigne}$. The input interface can also be used to enter other instruction parameters, such as an instruction for making a fabric with a plain weave or taffeta, a twill weave, a satin weave or an equivalent weave.

In the example shown, the heddle mechanism 18 is designed to split the heddles 24 into two groups of heddles. However, the number of heddle groups can be increased to make the fabric produced more flexible without thereby moving outside the scope of the invention. For example, the use of three or four groups of heddles makes it possible to achieve greater flexibility, without thereby significantly complicating the weaving method.

For example, in an arrangement in which the mechanism 18 splits the heddles 24 into four groups of heddles, a first group comprises the heddles 24*a*, 24*e* and 24*i*, a second group comprises the heddles 24*b*, 24*f* and 24*j*, a third group comprises the heddles 24*c* and 24*g*, and a fourth group comprises the heddles 24*d* and 24*h*. The heddle mechanism 18 is then appropriately arranged to distribute the groups of heddles into two sheets and to modify this distribution periodically. More specifically, the mechanism implements four successive steps. In each of the first, second, third and fourth steps respectively, the first, second, third or fourth group of heddles forms the first sheet, and the other three groups of heddles form the second sheet. The mechanism 18 is designed to repeat the succession of these four steps as long as the machine 2 is being used. Such an arrangement notably enables a fabric with a satin weave to be obtained. An arrangement in which the mechanism 18 divides the heddles 24 into three groups of heddles notably enables a fabric with a twill weave to be obtained.

Figure 6:
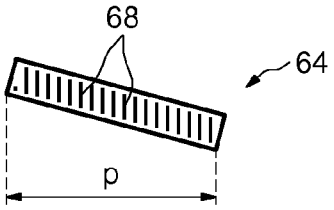
Figure 7:
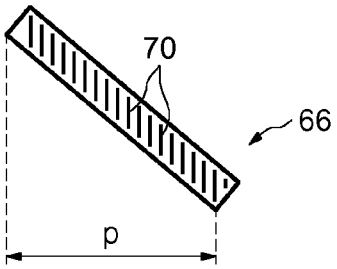

FIGS. 6 and 7 show two beaters 64 and 66 of the weaving machine 2 schematically. The beaters 64 and 66 are designed to be mounted on the support 67 (see FIGS. 1 and 3). The beater 64 has a plurality of slats 68 forming an angle of 70° in relation to the longitudinal direction of the beater. The beater 66 has a plurality of slats 70 forming an angle of 45° in relation to the longitudinal direction of the beater. The projection of the length of each beater 64 and 66 in relation to the direction perpendicular to the plane of the respective slat 68 and 70 is substantially equal to a single value p. The value p is substantially greater than the distance, in the direction of the vector $\vec{x}$, between the warp threads 16*a* and 16*j*. To mount a beater 64 or 66 on the support 67, the attachment screw 69 is engaged in a threaded borehole (not shown) in the beater 64 or 66. The angle formed between the longitudinal direction of the beater and the longitudinal direction of the support 67 is adjusted such that the slats 68 or 70 are substantially parallel to the plane formed by the vectors $\vec{y}$ and $\vec{z}$.

Advantageously, the machine 2 is provided with a plurality of beaters similar to the beaters 64 and 66, the slats of which form different angles in relation to the longitudinal direction of said beaters. For example, the machine 2 has a beater in which the slats form a 90° angle in relation to the longitudinal direction of said beater, a beater with a corresponding angle of 85°, a beater with a corresponding angle of 80°, etc. As explained below, this plurality of beaters forms a tool to enable the operator to produce fabrics with variable weaving angles.

Again with reference to FIG. 5, the shuttle 44 is provided with a guide device for the weft thread 43. The guide device has a first rod 72 extending perpendicular to the longitudinal direction of the shuttle 44 and a second rod 74. One of the ends of the second rod 74 is linked to the first rod 72 using pivot linking means 76. The other end of the second rod 74 has a guide fork 78 with two branches 80 and 82. The weft thread 43 passes between the branches 80 and 82 of the fork 78. The guide angle β formed between the rods 72 and 74 is adjusted as a function of the weaving angle in use by the machine 2. Selecting the appropriate angle β helps to improve control over the tension of the thread 43 laid.

In the example shown, a single shuttle 44 is provided with a guide device with an adjustable guide angle β. A plurality of shuttles having guide devices with different guide angles β can naturally be provided without thereby moving outside the scope of the invention, such that a shuttle having a guide device with a particular guide angle β is suited to each weaving angle. Such an alternative has the advantage of keeping the design of the shuttle 44 simple. Furthermore, since the shuttle is held in relation to the structure 4 using magnetic means, it is particularly easy to carry out the assembly, disassembly and replacement steps for the shuttles.

As mentioned previously, the shuttle 44 is held in relation to the structure 4 by three permanent magnets 36, 46 and 54 respectively provided on the rod 33 and at the ends 45 and 47 of the shuttle 44, and by an electromagnet 50 provided on the support 52. However, different magnetic means may be used without thereby moving outside the scope of the invention. In particular, at least one of the permanent magnets 36, 46 and 54 can be replaced by an electromagnet, in which case the electromagnet 50 can be replaced by a permanent magnet.

In other words, the assembly formed by the hitching means and the disconnection device 48 includes a single electromagnet and two or three permanent magnets. This enables the shuttle 44 to be moved without increasing the complexity of the weaving machine 2.

However, the arrangement in the example shown is advantageous where only one electromagnet needs to be powered, or where the electromagnet is easier to power if the electromagnet is mounted on the support 52 than if it were mounted on the shuttle 44, and to a lesser extent on the rod 33.

The weaving machine 2 can be used to implement the method according to the following non-limiting example embodiment of the invention. According to this example embodiment, the weaving method is intended to obtain a fabric with a weaving angle of 70°. However, the machine 2 can also be used to obtain a fabric having different parameters, notably forming any weaving angle of between 40° and 90°.

In this example embodiment, at the starting state of the method, the machine 2 is arranged according to the arrangement shown in FIG. 1. In other words, the section 31 forms an angle α of 90° in relation to the vector 9 and the shuttle 44 supports a spool 38 loaded with a weft thread 43. The shuttle 44 is attached using the magnets 36 and 46 to the end 35 of the rod 33, the rod 33 being arranged such that the end 35 is close to the pin 34. The electromagnet 50 is not powered with electrical energy.

During a first step, an operator uses the input interface of the device 58 to enter the instruction parameters. More specifically, the operator uses the input interface to enter a specific weaving angle, if required. In the present example embodiment, the operator enters a weaving angle $\alpha_{consigne}$=700 and a continuous weft-thread fabric.

During the second step, the device 58 controls the electric drive motor of the section 31 such that the angle α is equal to the angle $\alpha_{consigne}$. At the same time, the rod 33 pivots about the direction of the vector $\vec{z}$ to be positioned parallel to the direction of the weave, the end 35 being close to the pin 34. At this instant, the rod 33 is said to be arranged in the starting position.

In a third step, the operator selects a beater suited to the chosen angle $\alpha_{consigne}$ selected from the plurality of beaters provided with the machine 2. More specifically, the operator selects a slatted beater in which the slats form an angle with the longitudinal direction of the beater corresponding to the value of the angle $\alpha_{consigne}$. The operator then places the beater Selected on the movable support 68 thereof.

In a fourth step, the heddle mechanism 18 selectively moves a portion of the warp threads 16 such as to form an upper sheet and a lower sheet. In other words, the heddles 24*a*, 24*c*, 24*e*, 24*g* and 24*i* are shifted downwards and the heddles 24*b*, 24*d*, 24*f*, 24*h* and 24*j* are shifted upwards. Consequently, the warp threads 16*a*, 16*c*, 16*e*, 16*g* and 16*i* are selectively moved downwards and the warp threads 16*b*, 16*d*, 16*f*, 16*h* and 16*j* are selectively moved upwards. In other words, the weft threads 16 are moved selectively such as to form the sheets 28 and 30, as shown in FIG. 2.

In a fifth step, the device 58 controls the rack actuator such as to move the rod 33 towards the electromagnet 50. The rod 33 is thus moved leftwards (with reference to FIGS. 1 and 3) until the end 47 of the shuttle 44 comes into contact with the electromagnet 50. During this step, the spool 38 is unwound so that the weft thread 43 is laid in the longitudinal direction of the rod 33 between the sheets 28 and 30.

During a subsequent sixth step, the device 58 powers the electromagnet 50 with electrical energy. The force ε50-54 then it appears and the rigid assembly formed by the rod 33 on one hand and the shuttle 44 on the other is disconnected. The shuttle 44 is then rigidly connected to the electromagnet 50.

During a seventh step, the device 58 controls the rack actuator such as to return the rod 33 disconnected from the shuttle 44 to the starting position. The rod 33 is then moved rightwards (with reference to FIGS. 1 and 3) until the end 35 is again close to the pin 34.

During a subsequent eighth step, the heddle mechanism 18 selectively moves some of the warp threads 16 to a different arrangement than in the fourth step. The heddles 24*b*, 24*d*, 24*f*, 24*h* and 24*j* are then shifted downwards and the heddles 24*a*, 24*c*, 24*e*, 24*g* and 24*i* are shifted upwards. The warp threads 16*b*, 16*d*, 16*f*, 16*h* and 16*j* are therefore selectively moved downwards and the warp threads 16*a*, 16*c*, 16*e*, 16*g* and 16*i* are moved upwards. At the end of the eighth step, the position of the sheets 28 and 30 is then inverted in relation to the position thereof at the end of the fourth step.

In a ninth step, the device 58 again controls the rack actuator such as to move the rod 33 towards the electromagnet 50. The ninth step ends when the end 35 comes into contact with the end 45 of the shuttle 44.

During a tenth step, the device 58 deactivates the electrical energy supply to the electromagnet 50. This causes the force $\varepsilon_{50\text{-}54}$ to disappear, such that the shuttle 44 again forms a rigid assembly with the rod 33.

During an eleventh step, the device 58 controls the rack actuator such as to return the rod 33 to the starting position. The rod 33 is moved rightwards (with reference to FIGS. 1 and 3) until the end 35 of the rod 33 is close to the pin 34. During this step, the spool 38 is unwound so that the weft thread 43 is laid in the longitudinal direction of the rod 33 between the sheets 28 and 30.

The method includes a twelfth step of beating the weft thread laid. During this step, the beater (not shown) mounted by the operator is moved in translation in the direction and the sense of the vector $\vec{y}$. The beater, initially positioned between the heddle mechanism 18 and the being 15, moves beyond the beam 15 such as to push and beat the weft thread laid to an end position (not shown) between the beam 15 and the arm 12.

These twelve steps can be repeated as many times as required to obtain a fabric long enough for the intended use.

Advantageously, the machine 2 can also have clamps (not shown) mounted on the structure 4, and more specifically respectively mounted on the body 8 and on the arms 14, or on the section 31. The clamps are intended to maintain the tension of the weft thread when a weft thread is being laid between the warp threads 16. More specifically, each clamp respectively holds a portion of the weft thread Located to the left of the warp thread 16*a* And a portion of the weft thread Located to the right of the warp thread 16*j*. This hold is advantageously applied after the weft thread has been laid and before the beater is moved.

Thus, the weaving machine 2 and the method described above can be used to produce a continuous weft thread fabric with a variable weaving angle other than 90°. Furthermore, the overall production rate remains the same as with a conventional industrial weaving machine. Furthermore, the weaving machine does not have a more complex design and the corresponding weaving method does not involve any steps that are particularly complex for the operator. Compared to a conventional industrial weaving machine, the invention also makes it possible to control the tension of the weft thread laid at a weaving angle other than 90°. This results in a better quality fabric.

In the example embodiment illustrated, the machine 2 makes it possible to obtain a fabric with a continuous weft thread. However, the weaving machine 2 can also be used to obtain a fabric with a discontinuous weft thread without there by moving outside the scope of the invention. To do so, a cutting member designed to cut the weft thread with each pass of the shuttle 44 need simply be provided.

A particularly beneficial application of such a weaving machine relates to the manufacture of tyres. Indeed, by enabling the production of warp threads with continuous weft threads at a weaving angle other than 90°, the fabric produced is particularly suited for use as tyre reinforcement. Indeed, on account of the continuity of the weft threads and the arrangement thereof at a specific weaving angle, the fabric enables an enhanced transmission of the forces in the tyre and therefore between the road and the vehicle. Furthermore, by better controlling the tension of the weft thread, the quality of the tyre that can be made using the fabric produced also increases.

To do so, the fabric obtained using such a weaving machine and such a weaving method can be enveloped in a rubber mixture. Reinforced sections can then be cut from the rubber mixture, and portions taken therefrom to form crown plies or other reinforced portions of a tyre. In particular, the fabric made using a weaving method according to the invention can be enveloped in a rubber mixture using a calendering method.

An example fabric providing particularly satisfactory results when enveloped in a rubber mixture to produce a tyre is a fabric with metal warp threads, preferably steel, and a continuous weft thread, obtained using the method according to the invention with a weaving angle of approximately 60°.

Figure 8:
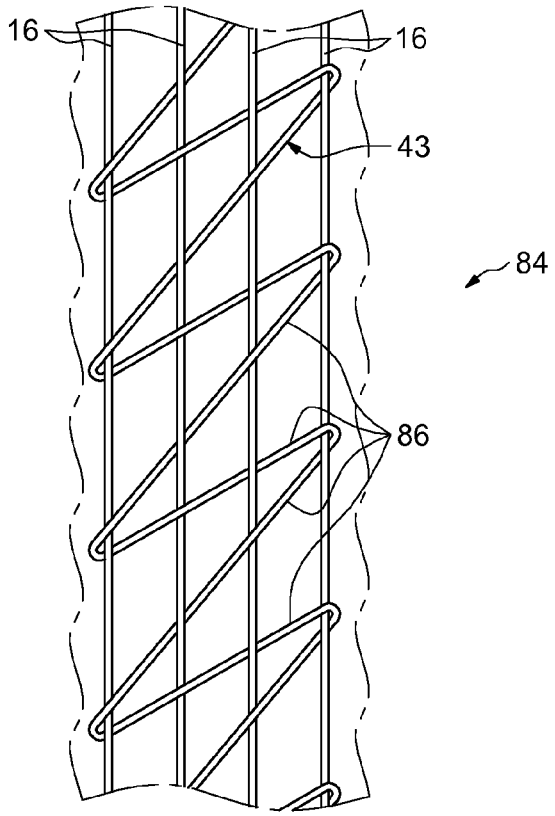
FIG. 8 is a top view of a fabric obtained using the weaving method according to the invention.
Figure 9:
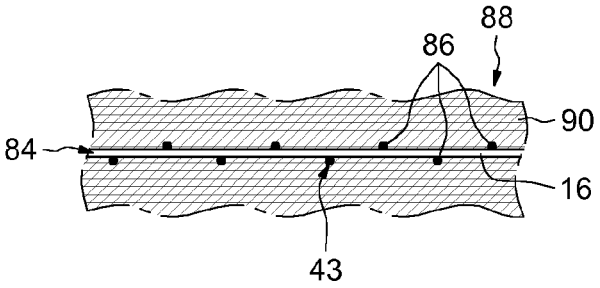
FIG. 9 is a cross-section view of a calendered product including the fabric in FIG. 8.

A fabric 84 according to an example embodiment of the invention is shown schematically in FIG. 8. The fabric 84 is designed to reinforce a calendered product 90, shown schematically in cross section in FIG. 9. FIG. 9 is a cross-section view of the calendered product comprising the fabric in FIG. 8, the cutting plane in FIG. 9 containing one of the warp threads of the fabric 84 in FIG. 8. Identical elements in FIGS. 8 and 9 are identified using the same reference signs.

With reference to FIG. 8, the fabric 84 is obtained using the method according to the example embodiment of the invention described above. The fabric 84 comprises a plurality of warp threads 16 and a continuous weft thread 43. For the sake of clarity, only four warp threads 16 are shown in the figure. The weft thread 43 extends between the warp threads 16 in a direction transverse to the direction of the warp threads 16. More specifically and as shown in FIG. 8, the weft thread 43 is divided into a plurality of passing portions 86 of substantially the same length. Each passing portion 86 extends from a warp thread located at one end of the plurality of warp threads 16 to the warp thread located at the opposite end of the plurality of warp threads 16. Furthermore, since the fabric 84 has a continuous weft thread, all of the passing portions 86 are connected together continuously. Furthermore, in the example shown, the weaving angle, i.e. the angle formed between the direction of the warp threads 16 and the direction of the passing portions 86 of the weft thread 43, is between 40° and 60°, the average weaving angle being substantially 50°.

In practice, the distance between two warp threads 16 respectively located at the two opposite ends of the plurality of warp threads 16 is greater than shown in FIG. 8. Consequently, for a passing portion 86, the difference between the angle formed between the direction of the warp threads 16 and the direction of the passing portion 86 and the average weaving angle is lesser.

FIG. 9 is a schematic view of the calendered product 88 including the fabric 84. The calendered product 88 is a composite product comprising a matrix 90 and the fabric 84 that forms the strengthening fabric. The fabric 84 is entirely immersed in the matrix 90. The matrix 90 is a rubber mixture. The calendered product 88 is formed by calendering using rollers (not shown) covering the fabric 84 with a thin layer of the rubber mixture of the matrix 90. Calendering enables optimum cohesion between the fabric 84 and the matrix 90. To further improve this cohesion, the warp threads 16 and the portions 86 of the weft thread 43 can be coated with a resorcinol-formaldehyde-latex (RFL) adhesive. Calendering enables the assembly of the strengthening fabric 84 with the other components of the tyre.

The invention claimed is:

1. A weaving machine comprising:

a structure able to support a plurality of warp threads extending in a first direction;

a heddles mechanism capable of selectively moving at least some of the plurality of warp threads to form first and second sheets of warp threads;

at least one weft-thread feed spool;

at least one support shuttle for the feed spool; and an actuating device able to control a movement of the at least one support shuttle between the first and second sheets of warp threads in at least one second direction transverse to the first direction, and in both senses relative to the second direction, to continuously lay weft thread coming from the feed spool between the sheets and in the second direction, wherein the actuating device includes a rack actuator and means for hitching a movable element of the rack actuator to the at least one support shuttle, and wherein the means for hitching include a first ferromagnetic element designed to cooperate with a second ferromagnetic element mounted on the at least one support shuttle, at least one of the first and second ferromagnetic elements being an electromagnet or a permanent magnet.

2. The weaving machine according to claim 1 further comprising means for adjusting a weaving angle α corresponding to an angle formed between the second direction and the first direction.

3. The weaving machine according to claim 2, wherein the adjustment means are designed to enable a variation in the weaving angle α between 40° and 90°.

4. The weaving machine according to claim 2, wherein the adjustment means include a mechanical pivot link designed to enable the actuating device to pivot about a direction perpendicular to the direction of the movement of the at least one support shuttle.

5. The weaving machine according to claim 2, wherein the adjustment means include a sliding mechanical link designed to enable the translational movement of a stop element for stopping the movement of the at least one support shuttle.

6. The weaving machine according to claim 1, wherein the structure has a device for disconnecting the at least one support shuttle from the actuating device, the disconnection device having an electromagnet or a permanent magnet.

7. The weaving machine according to claim 1 further comprising a slatted beater, the beater being removable.

8. The weaving machine according to claim 1, wherein the structure has at least one clamp positioned on one side of the plurality of warp threads in line with the second direction, the at least one clamp being designed to capture a weft thread when the weft thread is positioned between the warp threads.

9. The weaving machine according to claim 1, wherein the spool has means for orienting the output direction of the weft thread from the spool.

10. A weaving method using a weaving machine, the method comprising the steps of:

selectively moving at least some of a plurality of warp threads, the plurality of warp threads extending in a first direction, to form first and second sheets of warp threads;

controlling an actuating device to move at least one support shuttle for at least one feed spool for weft thread between the first and second sheets of warp threads in at least one second direction transverse to the first direction, and in both senses relative to the second direction, to continuously lay the weft thread coming from the feed spool between the sheets and in the second direction; and actuating hitching means of a movable element of the actuating device to rigidly connect the at least one support shuttle and the movable element together, the movable element being commanded to move between the first and second sheets of warp threads in the second direction and in a first sense, a device for disconnecting the at least one support shuttle from the actuating device is activated, the movable element being commanded to move between the first and second sheets of warp threads in the second direction and in a sense opposite the first sense, at least some of the plurality of warp threads are moved selectively to change a position of the first and second sheets of warp threads, the movable element being commanded to move between the first and second sheets of warp threads in the second direction and in the first sense, the disconnection device is deactivated, and the movable element being commanded to move between the first and second sheets of warp threads in the second direction and in the second sense.

11. The method according to claim 10, wherein each warp thread is made of steel, a textile material or both steel and a textile material.

12. A fabric obtained using the method according to claim 10.

* * * * *